United States Patent [19]

Yan

[11] 4,280,985

[45] Jul. 28, 1981

[54] PROCESS FOR THE ELUTION OF ION EXCHANGE RESINS IN URANIUM RECOVERY

[75] Inventor: Tsoung-yuan Yan, Philadelphia, Pa.

[73] Assignee: Mobil Oil Corporation, New York, N.Y.

[21] Appl. No.: 21,129

[22] Filed: Mar. 16, 1979

[51] Int. Cl.[3] ..... C01G 43/00

[52] U.S. Cl. ..... 423/7; 423/15

[58] Field of Search ..... 427/7, 15, 17

[56] References Cited

U.S. PATENT DOCUMENTS

| | | | |
|---|---|---|---|
| 2,811,412 | 10/1957 | Poirier | 423/7 |
| 3,265,471 | 8/1966 | Pottier et al. | 423/15 |
| 3,778,498 | 12/1973 | Yano et al. | 423/7 |
| 4,092,399 | 5/1978 | Narayan et al. | 423/7 |
| 4,155,982 | 5/1979 | Hunkin et al. | 423/7 |

*Primary Examiner*—Edward A. Miller

*Attorney, Agent, or Firm*—Charles A. Huggett; Michael G. Gilman; James F. Powers, Jr.

[57] ABSTRACT

Process for the recovery of uranium from a pregnant lixiviant employed in uranium leaching operations in which the uranium is concentrated by ion exchange resin. The ion exchange resin is eluted with an eluant containing 0.05–0.5 molar ammonium carbonate. The eluant also contains a base such as ammonium hydroxide in an amount sufficient to increase the pH to a value within the range of 9.0–11.0, thus increasing the carbonate/bicarbonate ratio. This enables the use of a relatively small quantity of ammonium carbonate to provide the desired carbonate ion concentration during the elution step.

6 Claims, No Drawings

PROCESS FOR THE ELUTION OF ION EXCHANGE RESINS IN URANIUM RECOVERY

BACKGROUND OF THE INVENTION

This invention relates to the production of uranium and more particularly to the elution of anionic ion exchange resins in uranium concentration procedures employing an ammonium carbonate eluant.

Uranium is produced from uranium-bearing ores by various leaching procedures which employ an alkaline or acid lixiviant to leach the uranium from its accompanying gangue material. The leaching operation may be carried out in conjunction with a surface milling operation in which the uranium ore is mined and then crushed and blended prior to leaching, heap leaching of ore piles at the surface of the earth, or in-situ leaching in which the lixiviant is introduced into a subterranean ore deposit and then withdrawn to the surface of the earth through suitable injection and production systems. Typically, the alkaline lixiviants are aqueous solutions of a suitable oxidizing agent such as oxygen or hydrogen peroxide and a leaching agent comprised of alkali metal or ammonium carbonates or bicarbonates or mixtures thereof. The pH of the lixiviant normally is within the range of about 7 to 10 at which the leaching agent functions to solubilize hexavalent uranium in the ore in the form of anionic uranyl complexes such as uranyl tricarbonate ions.

The pregnant lixiviant produced during the leaching operation is then treated in order to recover the uranium therefrom. In one conventional recovery procedure, a concentrated uranium solution is produced by passing the pregnant lixiviant over an anionic ion exchange resin and then eluting the resin with an eluant to desorb the uranium from the resin. The eluting procedure produces a relatively concentrated uranium solution in the effluent from the ion exchange column. This rich uranium solution, termed the "eluate", is then treated to precipitate uranium to produce the familiar "yellowcake". Among various eluants employed in uranium concentration are aqueous solutions of alkali metal or ammonium carbonates or bicarbonates. The eluant may also contain a suitable salt such as an alkali metal or ammonium chloride which, together with the carbonate or bicarbonate ions, functions to exchange the uranyl complex anion from the cationic adsorption sites on the resin.

The use of ammonium carbonate or bicarbonate is advantageous under certain circumstances since carbon dioxide and ammonia can be recovered from the rich eluate during the uranium precipitation process and then employed in forming fresh eluant. Thus, U.S. Pat. No. 2,811,412 to Poirier discloses the use of an aqueous solution of ammonium carbonate as an eluant. The ammonium carbonate is present in a relatively high concentration within the range of 10 to 25 percent. The uranium is recovered from the rich eluate by heating the solution, preferably to the boiling point whereby ammonia and carbon dioxide are driven off and uranium is precipitated. Poirier discloses that the ammonia and carbon dioxide released during heating of the eluate may be collected and reconverted to ammonium carbonate which is then recycled and used anew. Another uranium concentration process is disclosed in U.S. Pat. No. 4,092,399 to Narayan et al. In this procedure, the eluate is an aqueous solution of ammonium carbonate, bicarbonate, and chloride. The carbonate eluting agent is employed in relatively low concentrations of about 1 to 3 percent. During the processing step in which molybdenum is removed from the rich eluate prior to precipitation of uranium, the eluate is treated with hydrochloric acid. The carbon dioxide evolved during the acid treatment is used for elution solution makeup.

SUMMARY OF THE INVENTION

The present invention provides a new and improved process for the ion exchange concentration of uranium produced during leaching employing ammonium carbonate as an elution agent. The ammonium carbonate is employed in relatively low concentrations under high pH conditions which increase the ratio of carbonate ions to bicarbonate ions in the eluant. In carrying out the invention, the ion exchange resin is eluted with an eluant containing ammonium carbonate within the range of 0.05–0.5 molar and preferably within the range of 0.05–0.2 molar. The eluant also contains a base in a sufficient amount to increase the pH of the eluant to a value within the range of 9.0–11.0 and preferably to a value within the range of 9.3–10.3. In a preferred embodiment of the invention, the base is ammonium hydroxide and the eluant is formed by the addition of ammonia and carbon dioxide in a mole ratio of ammonia to carbon dioxide within the range of 2–5. In a further embodiment of the invention, the rich eluate resulting from the elution step is heated during the uranium recovery procedure to evolve carbon dioxide and ammonia which is then employed in making up fresh eluant.

DESCRIPTION OF SPECIFIC EMBODIMENTS

As noted previously, the recovery of uranium from pregnant lixiviant involves concentration of the uranium employing an ion exchange resin and subsequent precipitation to recover the uranium as yellowcake. The pregnant lixiviant is passed through one or more ion exchange columns operated in accordance with any suitable procedure. Such procedures are well known in the art and are described in Merritt, Robert C., THE EXTRACTIVE METALLURGY OF URANIUM, Colorado School of Mines Research Institute (1971) at page 167 et seq. under the heading "Ion Exchange Processes and Equipment". For example, the ion exchange column may be operated in a "fixed bed" mode or "moving bed" mode as described in Merritt. Ion exchange resins employed for uranium concentration are characterized by fixed cationic adsorption sites in which the mobile ion, typically chloride or another halide, is exchanged by the uranyl complex anion. Such anionic ion exchange resins are disclosed, for example, in the above-mentioned book by Merritt at pages 138–147 under the heading "Resin Characteristics". Suitable anionic ion exchange resins may take the form of polymers or copolymers of styrene substituted with quaternary ammonium groups or polymers or copolymers of pyridine which are quaternized to form pyridinium groups.

When the ion exchange resin becomes loaded with uranium, the ion exchange column is then switched to an elution cycle. An aqueous solution of ammonium carbonate employed as the eluant is passed through the ion exchange column to desorb uranium from the resin. The ammonium carbonate solution may also contain a salt such as an alkali metal or ammonium halide which also functions to exchange with the uranyl anion. Normally this will take the form of ammonium chloride or sodium chloride or mixtures thereof in a concentration of about 0.5 to 10 weight percent. The effluent from the ion exchange column, i.e. the eluate, is relatively rich in uranium and contains the uranium in a concentration significantly greater than the concentration of the original pregnant lixiviant.

The rich eluate from the ion exchange column is then treated to precipitate uranium therefrom. As noted in the aforementioned patent by Poirier, the eluate may be heated to evolve ammonia and carbon dioxide and to precipitate uranium. Thus, the rich eluate may be passed to a precipitation zone which takes the form of one or more stirred or baffled vessels. Heat may be supplied by any suitable technique such as by steam stripping. In this technique, steam is passed through the precipitator to heat the rich eluate to a suitable temperature, e.g. on the order of 200°–212° F., which causes carbon dioxide, ammonia and water to be evolved from the eluate. The uranium precipitates as a slurry of yellowcake which is permitted to settle from the solution. The settled yellowcake is then centrifuged or vacuum-filtered and dried to form the final product.

In the present invention, ammonium carbonate is employed in a relatively low concentration as an eluting agent. The eluant also contains a relatively strong base which elevates the pH of the eluant solution to a value within the range of 9.0–11.0 and increases the carbonate ion concentration during the eluting procedure.

Ammonium carbonate is disassociated and equilibrated in aqueous solution in accordance with the following relationships:

$$(NH_4)_2CO_3 \rightleftharpoons 2NH_4^+ + CO_3^= \quad (1)$$

$$CO_3^= + H^+ \rightleftharpoons HCO_3^- \quad (2)$$

Of the three major species in the solution, the carbonate and bicarbonate ions function to exchange with the anionic uranyl complexes previously adsorbed by the resin to desorb uranium into the solution to form the rich eluate. However, the carbonate ion is significantly more effective (by an order of magnitude) in this exchange mechanism than the bicarbonate ion. Thus, in the present invention, the carbonate ion concentration in the eluant is increased while still maintaining the gross ammonium carbonate concentration at a relatively low level of up to 0.5 molar and preferably within the range of 0.05–0.2 molar. This ultimately minimizes carbonate contamination of the yellowcake and reduces chemical and operation costs while maintaining a high uranium elution efficiency.

The carbonate to bicarbonate ratio ($CO_3^=/HCO_3^-$) is inversely proportional to the hydrogen ion concentration in accordance with the following relationship:

$$CO_3^=/HCO_3^- = (4.7\times10^{-11})/H^+ \quad (3)$$

wherein $CO_3^=$, $HCO_3^-$, and $H^+$ are concentrations of the indicated ions in the solution in moles per liter. From equation (3), it can be seen that the ratio of carbonate ion to bicarbonate ion increases tenfold for each increase in pH of 1. Thus, the ratio is about 1:100 for a pH of 8.3, 1:10 for a pH of about 9.3, and unity at a pH of about 10.3.

By way of example, a 1 mole per liter solution of ammonium carbonate exhibits a pH of about 9. From equation (3), the corresponding carbonate ion concentration is calculated to be about $4.5\times10^{-2}$ moles per liter. This same carbonate ion concentration can be achieved with only 0.14 moles per liter ammonium carbonate at a pH of 10. Similarly, if the pH of the solution is increased to about 10.3, the same carbonate ion concentration ($4.5\times10^{-2}$ mol/l) can be produced by 0.1 molar ammonium carbonate solution.

The pH level of the eluant may be increased by any suitable base which is relatively strong and has an alkalinity greater than that of the ammonium carbonate. Thus, a strong caustic such as sodium hydroxide may be used. It is preferred, however, to employ ammonium hydroxide and to form the eluant solution of ammonium carbonate and ammonium hydroxide by the addition of carbon dioxide and ammonia to the aqueous eluant medium.

The base is added in an amount to increase the pH of the eluant to a value within the range of 9.0–11.0. The pH level should not exceed 11.0 in order to avoid the precipitation of the uranium as ammonium uranate which will not be eluted from the ion exchange column. Preferably, the pH of the eluant entering the ion exchange column is within the range of 9.3–10.3 in order to provide a ratio of carbonate ions to bicarbonate ions ranging from about 0.1 to 1.

In the reaction of ammonia and carbon dioxide to produce ammonium carbonate, the stoichiometric equivalents of carbon dioxide, ammonia, and ammonium carbonate are 1, 2, 1, respectively, assuming there is no disassociation of ammonium carbonate to ammonium bicarbonate. In formulating fresh eluant, the mole ratio of ammonia to carbon dioxide normally should be within the range of 2–5 depending upon the desired concentration of ammonium carbonate and the desired pH. For example, for an ammonium carbonate concentration of 0.14 mol/l at a pH of 10, the mole ratio of ammonia to carbon dioxide should be about 4:1. Thus, the addition of carbon dioxide and ammonia in respective amounts of 6.2 and 9.6 grams per liter will yield a carbonate ion concentration in the eluant of $4.5\times10^{-2}$ mol/l. This may be contrasted with the much greater amounts of carbon dioxide and ammonia (44 and 34 g/l, respectively) required to produce the same carbonate ion concentration when employing prior art eluting techniques such as disclosed, for example, in the aforementioned patent to Poirier. Thus, it can be seen that the present invention is particularly useful in concentration techniques in which the rich eluate is heated to evolve carbon dioxide and ammonia because of the relatively small quantities of the materials which must be handled in the recycling system to form fresh eluant.

I claim:

1. In a method for the recovery of uranium from a pregnant lixiviant wherein uranium is adsorbed from said lixiviant by an anion ion exchange resin and thereafter eluted from said resin by contacting said resin with an eluant, the improvement comprising:

eluting said uranium from said resin with an eluant containing ammonium carbonate in a concentration within the range of 0.05–0.5 molar and a base in an amount sufficient to increase the pH of said eluant to a value within the range of 9.0–11.0.

2. The method of claim 1 wherein said eluant contains ammonium carbonate in a concentration within the range of 0.05–0.2 molar.

3. The method of claim 1 wherein the pH of said eluant is within the range of 9.3–10.3.

4. The method of claim 1 wherein said base is ammonium hydroxide.

5. The method of claim 4 wherein said eluant is formed by the addition of ammonia and carbon dioxide in a mole ratio of ammonia to carbon dioxide within the range of 2–5.

6. In a method for eluting uranium from an ion exchange column comprised of an anionic ion exchange resin having uranium adsorbed thereon, the steps comprising:

(a) eluting said ion exchange resin with an eluant having a pH within the range of 9.0–11.0 and containing ammonium carbonate in a concentration within the range of 0.05–0.5 molar to desorb uranium from said resin to form a rich eluate, (b) heating said rich eluate to evolve carbon dioxide and ammonia, and (c) recycling carbon dioxide and ammonia produced in step (b) to a fresh eluant stream and adding carbon dioxide and ammonia to said fresh eluant stream in a mole ratio of ammonia to carbon dioxide within the range of 2–5 to provide a pH of said fresh eluant stream within the range of 9.0–11.0.

* * * * *